US006773363B2

(12) United States Patent
Sullivan

(10) Patent No.: US 6,773,363 B2
(45) Date of Patent: Aug. 10, 2004

(54) HOLLOW LAYERED GOLF BALL

(75) Inventor: Michael J. Sullivan, Barrington, RI (US)

(73) Assignee: Acüshnet Company, Fairhaven, MA (US)

( * ) Notice: Subject to any disclaimer, the term of this patent is extended or adjusted under 35 U.S.C. 154(b) by 8 days.

(21) Appl. No.: 10/143,208

(22) Filed: May 10, 2002

(65) Prior Publication Data

US 2002/0132684 A1 Sep. 19, 2002

Related U.S. Application Data

(63) Continuation-in-part of application No. 09/821,641, filed on Mar. 29, 2001, now Pat. No. 6,595,874, which is a continuation-in-part of application No. 09/447,653, filed on Nov. 23, 1999, now Pat. No. 6,485,378.

(51) Int. Cl.[7] ..... A63B 37/02
(52) U.S. Cl. ..... 473/355
(58) Field of Search ..... 473/355, 375, 473/377, 358, 373, 374

(56) References Cited

U.S. PATENT DOCUMENTS

| | | | | | |
|---|---|---|---|---|---|
| 704,748 | A | | 7/1902 | Kempshall | |
| 757,600 | A | * | 4/1904 | Crawford | 473/355 |
| 790,954 | A | * | 5/1905 | Davis | 473/355 |
| 790,955 | A | * | 5/1905 | Davis | 473/355 |
| 1,255,388 | A | * | 2/1918 | Cobb | 473/355 |
| 1,524,171 | A | * | 1/1925 | Chatfield | 473/373 |
| 1,553,386 | A | * | 9/1925 | Kuhike | 473/355 |
| 2,181,350 | A | * | 11/1939 | Smith | 473/354 |
| 4,173,345 | A | | 11/1979 | Pocklington | 273/217 |
| 4,229,401 | A | | 10/1980 | Pocklington | 264/248 |
| 5,334,673 | A | | 8/1994 | Wu | 273/235 R |
| 5,484,870 | A | | 1/1996 | Wu | 528/28 |
| 5,692,973 | A | | 12/1997 | Dalton | 473/374 |
| 5,692,974 | A | * | 12/1997 | Wu et al. | 473/377 |
| 5,820,485 | A | | 10/1998 | Hwang | 473/361 |
| 5,836,834 | A | | 11/1998 | Masutani et al. | 473/374 |
| 5,919,100 | A | | 7/1999 | Boehm et al. | 473/354 |
| 5,984,807 | A | | 11/1999 | Wai et al. | 473/376 |

FOREIGN PATENT DOCUMENTS

| | | |
|---|---|---|
| WO | WO 00/23519 | 4/2000 |
| WO | WO 01/29129 | 4/2001 |

* cited by examiner

*Primary Examiner*—Raeann Gorden
(74) *Attorney, Agent, or Firm*—D. Michael Burns

(57) ABSTRACT

A golf ball having an improved core that comprises solid projections to produce a partially hollow core that is sectioned into hollow pockets separated by solid walls, thereby providing a durable core that has a reduced specific gravity. The projections being flexible to allow the core to deform upon impact without fracturing or failing in use. The volume occupied by the projections is less than the volume of the voided areas.

Partially hollow layers formed by projections that create compartments between layers. At least one hollow layer placed between the core and cover will reduce the specific gravity and allow for an increased amount of perimeter weighing.

5 Claims, 5 Drawing Sheets

HOLLOW LAYERED GOLF BALL

CROSS-REFERENCE TO RELATED APPLICATIONS

The present application is a continuation-in-part of U.S. patent application Ser. No. 09/821,641, filed on Mar. 29, 2001, now U.S. Pat. No. 6,595,874 which is a continuation-in-part of U.S. patent application Ser. No. 09/447,653 filed on Nov. 23, 1999 now U.S. Pat. No. 6,485,378. The disclosures of which are incorporated herein in their entirety.

FIELD OF THE INVENTION

This invention generally relates to golf balls and, more particularly, to a selectively weighted golf ball having at least one hollow layer and/or an improved hollow core.

BACKGROUND OF THE INVENTION

Conventional golf balls have been designed to provide particular playing characteristics. These characteristics typically include initial velocity, compression, and spin of the golf ball, and can be optimized for various types of players. For example, certain players prefer a ball that has a high spin rate in order to control the flight of the ball and to stop the golf ball on the green. This type of ball, however, does not usually provide maximum distance. Other players prefer a ball that has a low spin rate and high resiliency to maximize distance.

Early solid golf balls were generally comprised of a hard core and a hard cover. Generally, if the golf ball has a soft core and a hard cover, it has a low spin rate. If the golf ball has a hard core and a hard cover, it exhibits very high resiliency for distance, but a "hard" feel and is difficult to control on the greens. Additionally, if the golf ball has a hard core and a soft cover, it will have a high rate of spin. More recently developed solid balls are comprised of a core, at least one intermediate layer, and a cover. The intermediate layers improve the playing characteristics of solid balls and can be composed of thermoset or thermoplastic materials.

Typically, solid golf ball cores are spherical and solid. In an effort to improve the spin rate of balls, the weight distribution in the golf ball has been varied by concentrating the weight either in the spherical inner cores or in the mantle(s) near the surface of the ball. It is desired, therefore, to provide a golf ball with symmetrical, non-spherical weight distribution that provides unique spin rate characteristics.

Several patents are directed to golf balls having hollow cores, and projections emanating from the cores.

U.S. Pat. Nos. 5,820,485 and 5,836,834, issued to Hwang and Matsutani respectively, disclose solid projections on a core, the space around which is filled with outer core material, with no voids or air space.

U.S. Pat. No. 5,984,807 issued to Wai discloses a core having a plurality of projections defining an interstitial space and a layer disposed within the interstitial space. The geometric shaped core is manufactured by first providing flexible, resilient, honeycombed inserts to be used in a conventional compression mold, the inserts placed in upper and lower mold halves wherein the core material is then added and molded. But, the interstitial spaces are not hollow, they are filled with cover material.

The prior art discloses many ball patents having projections. Some of these include U.S. Pat. Nos. 5,692,973 (Dalton), 4,173,345 and, 4,229,401 (Pocklington). Many patents disclose hollow cores including U.S. Pat. No. 704,748 to Kempshall and U.S. Pat. No. 5,480,395 to Molitor.

However, these patents do not disclose a golf ball having the configuration as disclosed herein to provide the improved golf balls of the present invention.

SUMMARY OF THE INVENTION

The present invention is directed to a golf ball having a layer and/or a core geometry designed to provide improved playing characteristics such as spin rate.

The present invention is also directed to a golf ball having an improved core that comprises either solid struts, pillars or supports to produce a partially hollow core that is sectioned into hollow pockets separated by solid walls, thereby providing a durable core that has a reduced specific gravity. The struts, pillars or supports being flexible to allow the core to deform upon impact without fracturing or failing in use. It is preferable that the volume occupied by the struts, pillars or structures be less than the volume of the voided areas.

The present invention is further directed to a golf ball having at least one hollow layer, preferably placed between the innermost core and an outermost core layer. However, this layer can be placed between the outer core layer and inner cover layer, or between two cover layers. The hollow layer will reduce the specific gravity, improve feel, modify sound and/or impact response and also spin properties.

An embodiment of the invention will provide a double hollow golf ball that will combine the hollow inner core structure and encase it with a hollow outer core layer.

Another embodiment of the invention would provide a golf ball with a solid inner core and multiple hollow layers.

BRIEF DESCRIPTION OF THE DRAWINGS

In the accompanying drawings, which form a part of the specification and are to be read in conjunction therewith and in which like reference numerals are used to indicate like parts in the various views.

DETAILED DESCRIPTION OF THE PREFERRED EMBODIMENTS

Figure 1:
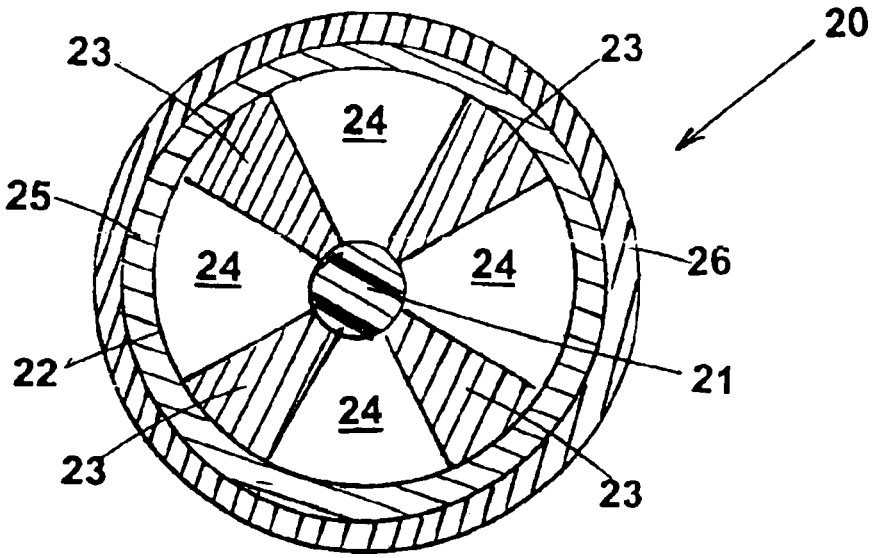
FIG. 1 is a cross-sectional view illustrating an embodiment of the present invention.

Referring to FIG. 1, a substantially spherical golf ball 20 of the present invention is shown. It comprises a core 21, a partially hollow core layer 22 that is comprised of a plurality of flexible and solid struts 23, an outer core layer 25, and at least one cover layer 26. The hollow core layer 22 is comprised of a plurality of flexible and solid struts 23 that create hollow compartments 24 therein.

Figure 2:
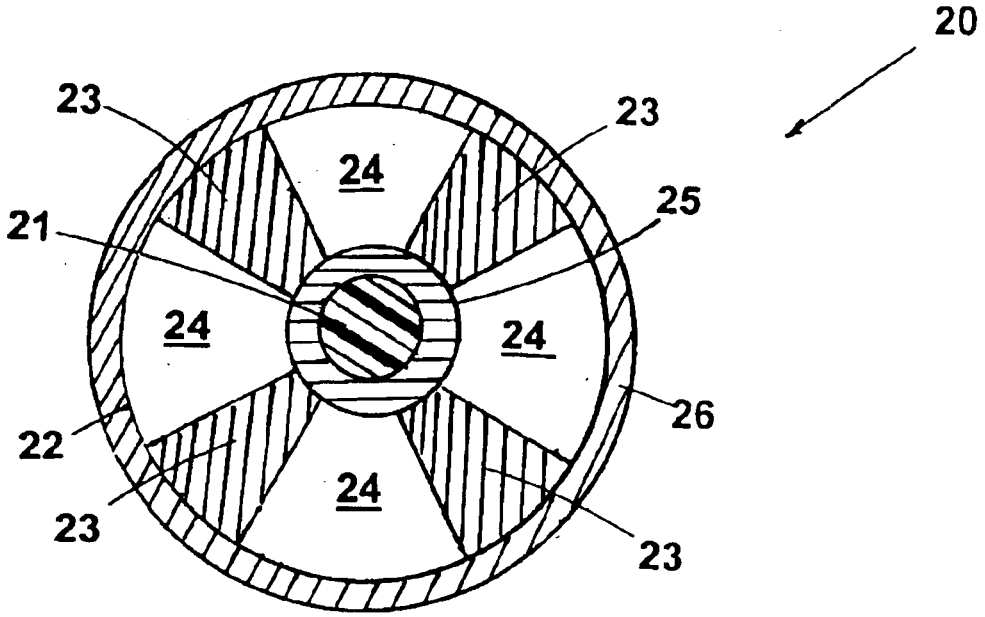
FIG. 2 is a cross-sectional view of another embodiment of the present invention.

Another embodiment of the golf ball 20 of the above invention is shown in FIG. 2. It includes placing the partially hollow core layer 22 between the core layer 25 and at least one cover layer 26. Partially hollow core layer 22 reduces specific gravity, improves feel, modifies sound and/or impact response and alters the resultant spin characteristics. Struts 23 have flexibility so as to allow core layer 22 to deform upon impact without fracturing or failing in use. It is preferable that the volume occupied by the struts 23 be less than the volume of the hollow compartments 24.

Figure 3:
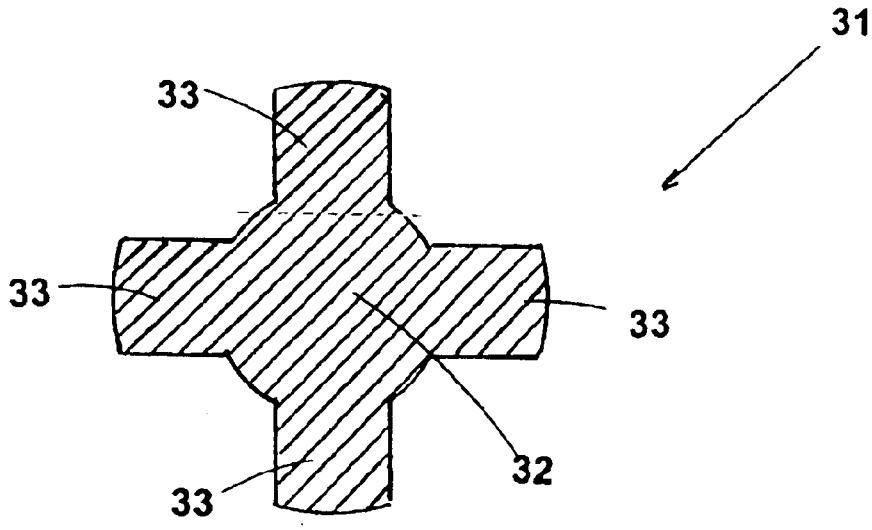
FIG. 3 is a cross-sectional view of a solid golf ball core having molded pillars extending therefrom.
Figure 4:
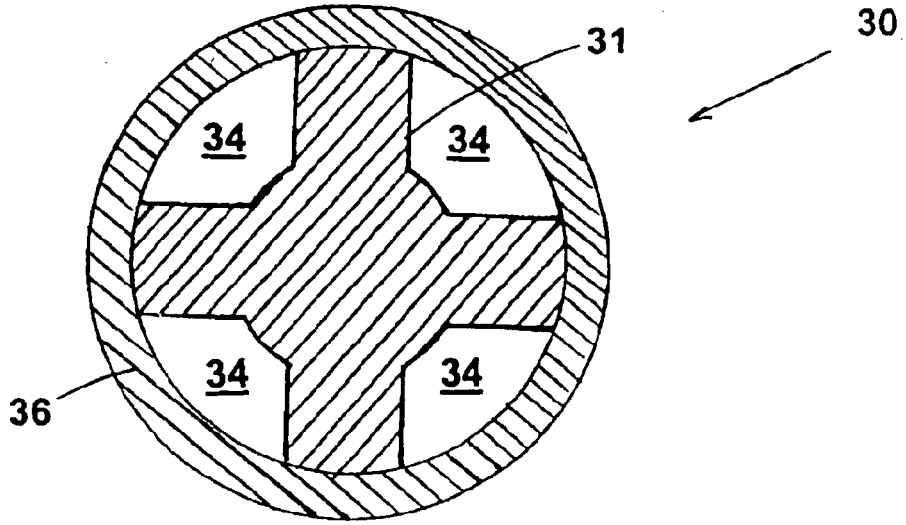
FIG. 4 is a cross-sectional view of a golf ball having a cover formed over the core of FIG. 3.

As shown in FIGS. 3 and 4, a core 31 is comprised of a solid inner core 32 that is molded with a plurality of pillars 33 which extend radially outward therefrom. Pillars 33 spaced from one another so as to form hollow sections 34 therein when the core 31 is enclosed by at least one cover layer 36 to form a golf ball 30. The ball 30 is made by forming half shells, in this embodiment the shells being the cover layer 36. The shells may be thermoplastic or thermosetting material and they are first molded into half shells. The pillars 33 are shaped so that the core 31 is substantially symmetrical. The core 31 is placed into a bottom shell and then a top shell is placed over it. The two half shells are joined together over the core 31 leaving a hollow sections 34 between the core 31 and the outer core or inner cover layer 36. The purpose of this golf ball 30 is to provide a durable core 31 that has reduced specific gravity, thereby allowing for additional perimeter weighing. This is important for golf balls made in accordance to the standards of the U.S.G.A. that limits the weight of a golf ball to about 1.62 ounces.

Figure 5:
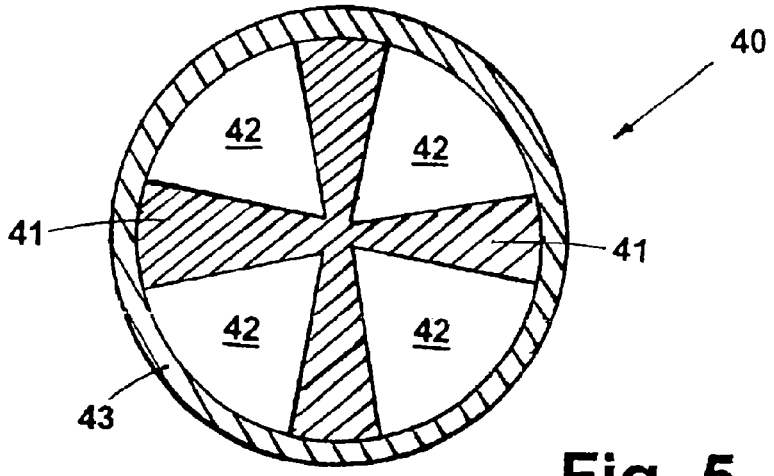
FIG. 5 is a cross-sectional view of a golf ball core showing an embodiment of the present invention.
Figure 6:
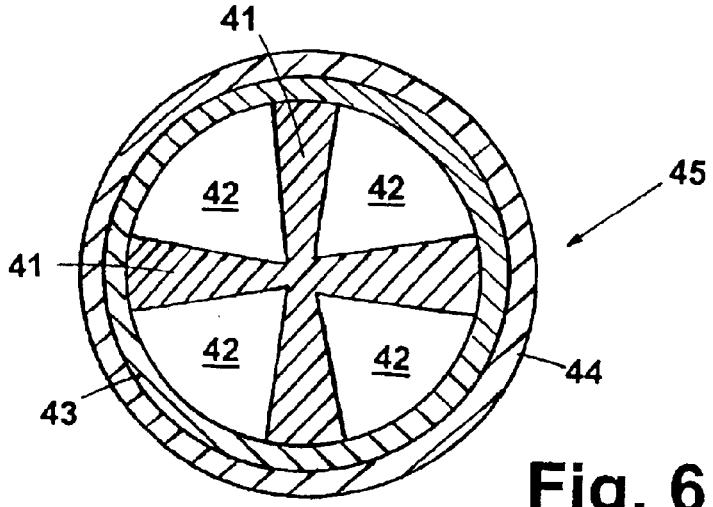
FIG. 6 is a cross-sectional view of a golf ball made by covering the core of FIG. 5.
Figure 7:
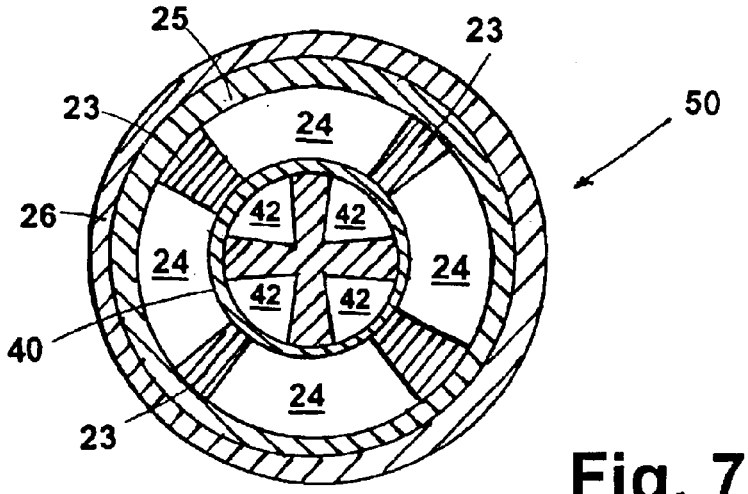
FIG. 7 is a cross-sectional view of a double-hollow ball made by using a hollow inner core as shown in FIG. 6 and encasing it in a hollow layer as depicted in FIG. 2.

As illustrated in FIG. 7, a golf ball 50 having multiple hollow layers is made by substituting the core 21 of FIG. 1 with the center portion 40 as shown in the FIG. 5.

Figure 8A:
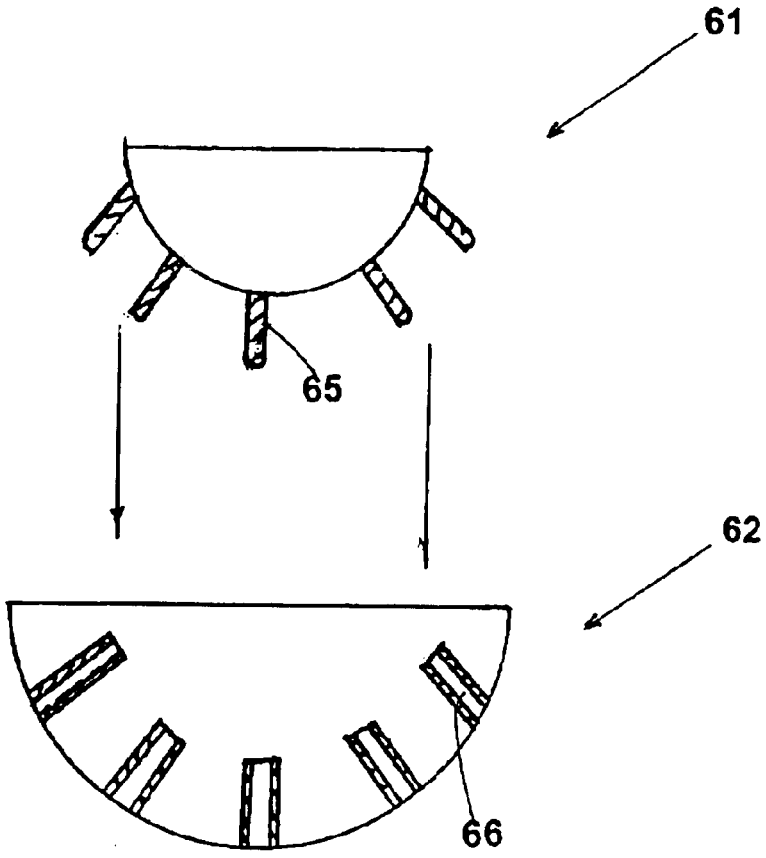
FIG. 8*a* is an expanded sectional view illustrating the construction of a hollow hemisphere layer of an embodiment of the invention.
Figure 8B:
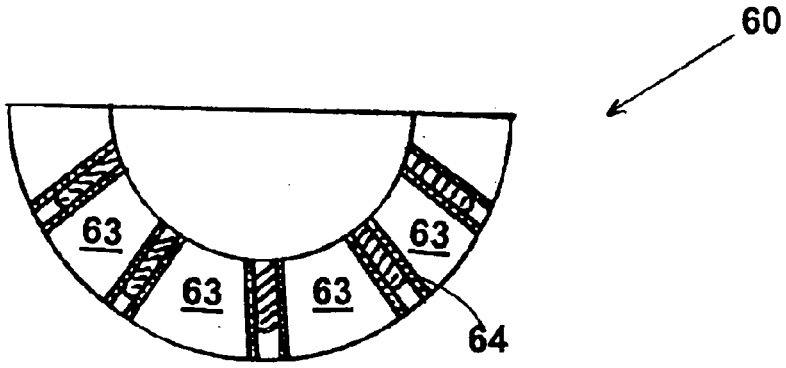
FIG. 8*b* is a cross-sectional view of the completed hollow hemisphere layer of FIG. 8*a*.
Figure 8C:
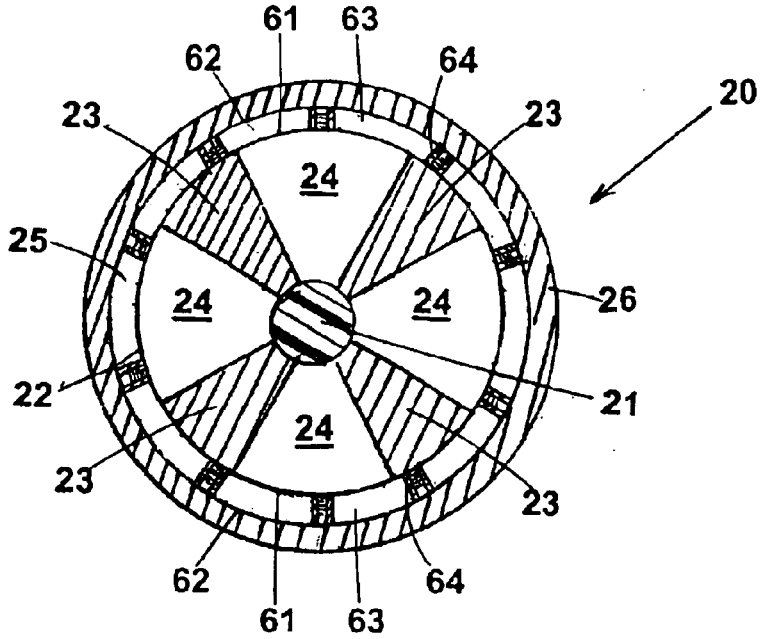
FIG. 8*c* is a cross-sectional view of the golf ball of FIG. 1, with a partially hollow outer core layer comprised of hemisphere layers of FIG. 8*b*.
Figure 8D:
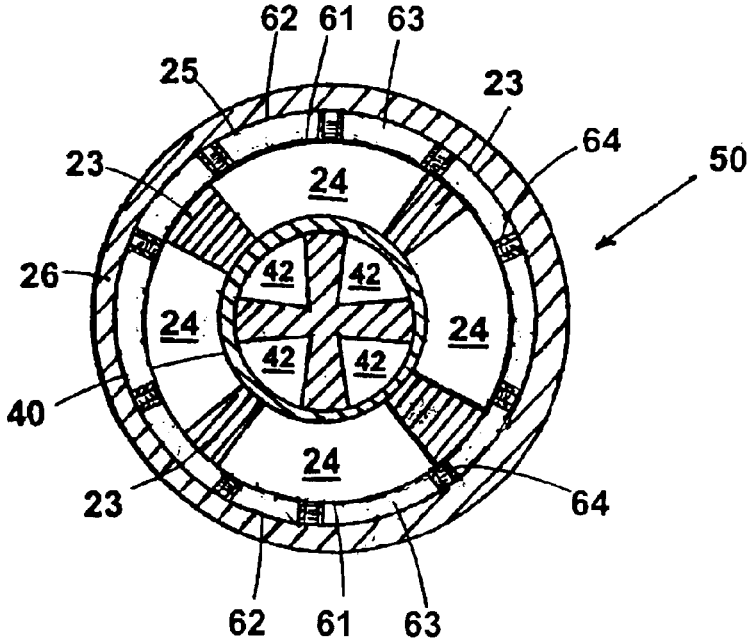
FIG. 8*d* is a cross-sectional view of the golf ball of FIG. 7, with a partially hollow outer core layer comprised of hemisphere layers of FIG. 8*c*.

Referring to FIGS. 8*a,* 8*b,* 8*c* and 8*d* a partially hollow layer 60 is formed by joining a male and female hemispherical shell, 61 and 62 respectively, so that when joined, the mating produces half shells with hollow passages 63 separated from each other by flexible ribs 64. Ribs 64 formed by the engagement of elongated protruding members 65 of male half shell 61 with elongated channels 66 of female half shell 62. The half shells are then placed at a pre-determined position in the golf ball. The partially hollow layer 60 may be substituted for a partially hollow inner or outer core layer, or it could also be employed as a partially hollow inner or outer cover layer, by combining the half shells about a golf ball component, as shown in FIG. 8*c*. The hollow layer 60 may also be formed using methods associated with composite golf club shaft or tennis racket manufacture such as "air bag" pressurized insert techniques, wherein a bag is inflated within a material to force the material against a mold as the material is cured or hardened, thereby upon cooling leaving a hollow molded part. Further a wax or sacrificial pre-form may be over-molded with material to form a part, the wax then removed to leave a hollow part.

The golf balls of the invention have unique constructions that enable more precise weight distribution than previously designed golf balls via the use of hollow layers, compartments, or cavities, preferably placed between at least an innermost core and an outermost cover. Further the invention details novel hollow cores that may be used separately or in conjunction with the hollow layers.

The flexible projections described herein, as struts 23, pillars 33, supports 41 and ribs 64 have been simplified for the purpose of clarity. These projections may be of any shape or geometry such as circular, cylindrical, non-circular polygonal, etc. and no differentiation is made between the definition of a strut, a pillar, a rib, or a support, as they are all projections. As previously stated, it is preferred that the projections occupy a volume of the hollow layer that is less than the voided volume created by the hollow layer. It is an objective of the present invention to minimize the specific gravity of the hollow layer yet still make it formable.

An embodiment not shown but anticipated as a possible manufacturing technique to develop hollow layers is the use of a honeycombed layer formed of an appropriate material. The honeycombed layer is a sandwich structure designed like a honeycomb having vertical walls wedged between two outer flat sheets or panels. The face sheets carry tensile and compressive loads and the honeycomb carries transverse stresses. A variety of carbon, aramid, aramid paper honeycomb engineering materials are available in the market place. Additionally, honeycombs may be made using rigid or flexible polymers giving a honeycomb that could be formed into half-shells of a golf ball or otherwise formed or fitted over a core to form a hollow layer. Depending upon the desired density of the hollow layer, the honeycomb (or any other 3 dimensional geometric structure) wall thickness and materials may be varied, i.e. a face sheet of one material and vertical walls of another may be used. Further some honeycombs may be filled in with a material in a random or pre-determined arrangement.

Another embodiment, not shown but anticipated, may be the use of flexible and/or formable hollow tubes that may be wrapped, wound or otherwise positioned over a core to form a hollow layer over which a cover(s) may be applied. The wall thickness, material and cross-sectional geometry of the tube will determine the density of the layer. The tubes serve primarily to take up space but may also provide feel, resilience under certain conditions, but need not be applied under high tension as with a conventional winding.

The materials of composition for the solid portion of the hollow layer comprising of the upper and lower surfaces and the flexible projections can be used in conjunction with homopolymeric and copolymer materials such as:

(1) Vinyl resins such as those formed by the polymerization of vinyl chloride, or by the copolymerization of vinyl chloride with vinyl acetate, acrylic esters or vinylidene chloride.

(2) Polyolefins such as polyethylene, polypropylene, polybutylene and copolymers such as ethylene methylacrylate, ethylene ethylacrylate, ethylene vinyl acetate, ethylene methacrylic or ethylene acrylic acid or propylene acrylic acid and copolymers and homopolymers produced using single-site catalyst.

(3) Polyurethanes including those prepared from polyols and diisocyanates or polyisocyanates and those disclosed in U.S. Pat. No. 5,334,673.

(4) Polyureas such as those disclosed in U.S. Pat. No. 5,484,870.

(5) Cationic and anionic polyurethane and polyurea ionomers, including:

(a) thermoplastic and thermoset cationic polyurethane and polyurea ionomers containing cationic moieties such as quaternized nitrogen groups associated with halide or acetate anion either on the pendant or polymer backbone of polyurethane or polyurea, or (b) thermoplastic and thermoset anionic polyurethane and polyurea ionomers containing anionic moieties such as carboxylate or sulfonate or phosphonate neutralized with counter cations either on the pendant or polymer backbone of polyurethane or polyurea.

(6) Non-elastic thermoplastics like polyesters and polyamides such as poly(hexamethylene adipamide) and others prepared from diamines and dibasic acids, as well as those from amino acids such as poly(caprolactam). Still further, non-elastic thermoplastics can include polyethylene terephthalate, polybutylene terephthalate, polyethylene terephthalate/glycol (PETG), polyphenylene oxide resins, and blends of non-elastic thermoplastics with Surlyn, polyethylene, ethylene copolymers, ethylene-propylene diene terpolymer, etc.

(7) Acrylic resins and blends of these resins with poly vinyl chloride, elastomers, etc.

(8) Thermoplastic rubbers such as olefinic thermoplastic rubbers including blends of polyolefins with ethylene-propylene diene terpolymer.

(9) Thermoplastic elastomers including block copolymers of styrene and butadiene, or isoprene or ethylene-butylene rubber, copoly (ether-amides) such as "Pebax" sold by Elf Atochem, copoly (ether-ester) block copolymer elastomers sold under the trademarks "Hytrel" by E. I. DuPont De Nemours & company of Wilmington, Del. and "Lomod" by General Electric Company, Pittsfield, Mass.

(10) Blends and alloys, including polycarbonate with acrylonitrile butadiene styrene, polybutylene terephthalate, polyethylene terephthalate, styrene maleic anhydride, polyethylene, elastomers, etc. Blends such as polyvinyl chloride with acrylonitrile butadiene styrene or ethylene vinyl acetate or other elastomers. Blends of thermoplastic rubbers with polyethylene, polypropylene, polyacetal, polyamides, polyesters, cellulose esters, etc.

(11) Saponified polymers and blends thereof, including: saponified polymers obtained by reacting copolymers or terpolymers having a first monomeric component having olefinic monomer from 2 to 8 carbon atoms, a second monomeric component comprising an unsaturated carboxylic acid based acrylate class ester having from 4 to 22 carbon atoms, and an optional third monomeric component comprising at least one monomer selected from the group consisting of carbon monoxide, sulfur dioxide, an anhydride, a glycidyl group and a vinyl ester with sufficient amount of an inorganic metal base. These saponified polymers can be blended with ionic and non-ionic thermoplastic and thermoplastic elastomeric materials to obtain a desirable property.

(12) Copolymer and terpolymers containing glycidyl alkyl acrylate and maleic anhydride groups, including: copolymers and terpolymers containing glycidyl alkyl acrylate and maleic anhydride groups with a first monomeric component having olefinic monomer from 2 to 8 carbon atoms, a second monomeric component comprising an unsaturated carboxylic acid based acrylate class ester having from 4 to 22 carbon atoms, and an optional third monomeric component comprising at least one monomer selected from the group consisting of carbon monoxide, sulfur dioxide, an anhydride, a glycidyl group and a vinyl ester. The above polymers can be blended with ionic and non-ionic thermoplastic and thermoplastic elastomeric materials to obtain a desirable mechanical property.

(13) HiCrystalline acid copolymers and their ionomers, including: acid copolymers or its ionomer derivatives formed from an ethylene and carboxylic acid copolymer comprising about 5 to 35 percent by weight acrylic or methacrylic acid, wherein said copolymer is polymerized at a temperature of about 130° C. to about 200° C. and a pressure of about 20,000 to 50,000 psi and wherein up to about 70 percent to of the acid groups were neutralized with a metal ion.

(14) Mg ionomers formed from an olefin and carboxyllic acid copolymer comprising about 5 to 35 weight percent of acrylic or methacrylic acid which are neutralized up to 60 weight percent by magnesium oxide or magnesium acetate or magnesium hydroxide.

Preferably, the cover materials for the ball is comprised of polymers such as ethylene, propylene, butene-1 or hexane-1 based homopolymers and copolymers including functional monomers such as acrylic and methacrylic acid and fully or partially neutralized ionomer resins and their blends, methyl acrylate, methyl methacrylate homopolymers and copolymers, imidized, amino group containing polymers, polycarbonate, reinforced polyamides, polyphenylene oxide, high impact polystyrene, polyether ketone, polysulfone, poly(phenylene sulfide), acrylonitrile-butadiene, acrylic-styrene-acrylonitrile, poly(ethylene terephthalate), poly(butylene terephthalate), poly(ethylene vinyl alcohol), poly(tetrafluoroethylene) and their copolymers including functional comonomers and blends thereof. Still further, the cover 11 is preferably comprised of a polyether or polyester thermoplastic urethane, a thermoset polyurethane, an ionomer such as acid-containing ethylene copolymer ionomers, including E/X/Y copolymers where E is ethylene, X is an acrylate or methacrylate-based softening comonomer present in 0–50 weight percent and Y is acrylic or methacrylic acid present in 5–35 weight percent. The acrylic or methacrylic acid is present in 16–35 weight percent, making the ionomer a high modulus ionomer, in 10–12 weight percent, making the ionomer a low modulus ionomer or in 13–15 weight percent, making the ionomer a standard ionomer. Generally, high acid ionomers provide a harder, more resilient ionomer. Covers made using high acid ionomers usually provide a high initial velocity and a low spin rate. on the other hand, covers made with a low modulus ionomer are generally softer and provide greater spin and control. Also highly neutralized polymers such as those disclosed in WO 00/23519 and WO 01/29129 are preferable materials.

The inner and outer core materials preferably have substantially different material properties so that there is a predetermined relationship between the inner and outer core materials, to achieve the desired playing characteristics of the ball such as the spin rate of the ball. For instance, an inner core may be constructed from a low specific gravity material having a specific gravity of less than 0.9 or preferably less than 0.8. An outer core layer on the other hand, is preferably made from a high specific gravity material having a specific gravity of greater than 1.2, more preferably greater than 1.5 and most preferably greater than 1.8. Since the outer core layer is denser and located more radially outward relative to inner, the golf ball has a high moment of inertia and a low spin rate.

On the other hand, to make a low moment of inertia or high spin rate ball, the inner core 32 of core 31, FIGS. 3 and 4, may be constructed from a high specific gravity material. Pillars 33, outer core layer and/or inner cover layer 36 or any combination of these elements can be made from a low specific gravity material. Preferably, core 31 has a specific gravity of greater than 1.2, more preferably greater than 1.5 and most preferably greater than 1.8. Preferably, the low specific gravity material has a specific gravity of less than 0.9 and more preferably less than 0.8. Inner core 32 can also be filled preferably with a non-reactive high specific gravity liquid such as glycerin or carbon tetrachloride.

Suitable fluids usable in accordance with their specific gravities include air, aqueous solutions, liquids, gels, foams, hot-melts, other fluid materials and combinations thereof. Examples of suitable liquids include either solutions such as salt in water, corn syrup, salt in water and corn syrup, glycol and water or oils. The liquid can further include pastes, colloidal suspensions, such as clay, barytes, carbon black in water or other liquid, or salt in water/glycol mixtures. Examples of suitable gels include water gelatin gels, hydrogels, water/methyl cellulose gels and gels comprised of copolymer rubber based materials such a styrene-butadiene-styrene rubber and paraffinic and/or naphthenic oil. Examples of suitable melts include waxes and hot melts. Hot-melts are materials, which at or about normal room temperatures are solid but at elevated temperatures become liquid. A high melting temperature is desirable since the liquid core is heated to high temperatures during the molding of the inner core, outer core, and the cover. Alternatively, the liquid can be a selective reactive liquid system, which combines to form a solid. Examples of suitable reactive liquids are silicate gels, agar gels, peroxide cured polyester resins, two part epoxy resin systems, peroxide cured liquid polybutadiene rubber compositions, reactive polyurethanes, silicones and polyesters.

Suitable inner and outer core materials include thermosets, such as rubber, polybutadiene, polyisoprene; thermoplastics such as ionomer resins, polyamides or polyesters; or a thermoplastic elastomer. Suitable thermoplastic elastomers include Pebax®, Hytrel®, thermoplastic urethane, and Kraton®, which are commercially available from Elf-Atochem, DuPont, various manufacturers, and Shell, respectively. The inner and outer core materials can also be formed from a castable material. Suitable castable materials include urethane, polyurea, epoxy, and silicone. Additionally, other suitable core and cover materials are disclosed in U.S. Pat. No. 5,919,100, issued to Boehm et al., which is incorporated in its entirety herein by reference.

More specifically, the low specific gravity materials can be manufactured from a plastic polymer embedded with a density reducing filler such as hollow spheres or microspheres or is otherwise reduced in density, e.g., with foam. Additionally, suitable materials include a nucleated reaction injection molded polyurethane or polyurea, where a gas, typically nitrogen, is essentially whipped into at least one component of the polyurethane, typically, the pre-polymer, prior to component injection into a closed mold where full reaction takes place resulting in a cured polymer having reduced specific gravity. The materials are referred to as reaction injection molded ("RIM") materials. On the other hand, the high specific gravity layer may be made from a high density metal or from high density metal powder encased in a polymeric binder. High density metals such as steel, tungsten, lead, grass, bronze, copper, nickel, molybdenum or their alloys.

In accordance to another aspect of the invention, core 31 is a pre-formed selectively weighted structure. Preferably, the pre-formed selective weighted structure is a solid unitary element for the ease of manufacture. However, the present invention is not so limited. For example, as described above the pillars 33 can be made from a different material than inner core 32 to achieve a desired weight distribution. The selectively weighted structure may be overmolded in any suitable fashion with outer core materials to form the core of a golf ball. Injection molding, compression molding, reaction injection molding and casting are some of the preferred manufacturing methods. The pre-formed inserts in accordance to the present invention can focus or concentrate the weight of the ball either at the center of the ball, or at discrete locations proximate the ball's outer surface. These discrete locations are positioned symmetrically relative to the ball's outer surface so as not to affect the aerodynamic and rolling characteristics of the ball. The core or other mantle layers can be molded around the pre-formed insert such that they either fully enclose the pre-formed insert, or enclose most of the insert with the possibility of leaving some portions exposed or visible on the finished surface of the ball by leaving these portions flush with the surface.

While it is apparent that the illustrative embodiments of the invention disclosed herein fulfill the objectives stated above, it is appreciated that numerous modifications and other embodiments may be devised by those skilled in the art. One such modification is that the outer surface can be flush with the inner surface free ends or it can extend beyond the free ends. Therefore, it will be understood that the appended claims are intended to cover all such modifications and embodiments, which would come within the spirit and scope of the present invention.

What is claimed is:

1. A golf ball comprising:

a core having a plurality of equilaterally spaced struts extending radially outward;

a partially hollow outer core layer molded over the core;

a plurality of hollow compartments defined by the core, struts and partially hollow outer core layer;

the partially hollow outer core comprising;

a pair of hemispherical shells, each shell comprised of a male and a female half shell, the male half shell having a plurality of elongated protruding members, the female half shell having a plurality of ribs, each rib including elongated channel therein, the channels of a size and configuration for friction fitting with the protruding members of the male half shell, a plurality of hollow passages defined by the ribs, and the unification of the male and female half shells; and at least one cover layer disposed around the outer core layer.

2. A hollow golf ball comprising:

a partially hollow core comprising:

a center portion, a plurality of non-spherically equidistantly spaced supports extending outwardly from the center portion, a core layer molded about the center portion and supports, a plurality of hollow cavities defined by the center portion, supports and core layer; and the core layer having a plurality of equilaterally spaced struts extending radially outward;

an outer core layer molded over the core;

a plurality of hollow compartments defined by the core layer, the outer core layer, and the struts; and at least one cover layer disposed around the outer core layer.

3. The golf ball according to claim 2, wherein the outer core layer is a partially hollow layer comprising:

a pair of hemispherical shells;

each shell comprised of a male and a female half shell;

the male half shell having a plurality of elongated protruding members;

the female half shell having a plurality ribs, each rib including an elongated channel therein, the channels of a size and configuration for friction fitting with the protruding members of the male half shell; and a plurality of hollow passages defines by the ribs, and the unification of the male and female half shells.

4. The golf ball according to claim 2, wherein the cover layer is a thermosetting material.

5. The golf ball according to claim 2, wherein the cover layer is a thermoplastic material.

* * * * *